US007232523B2

(12) United States Patent
Clay

(10) Patent No.: US 7,232,523 B2
(45) Date of Patent: Jun. 19, 2007

(54) POOL LEAF REMOVAL NET

(75) Inventor: Ross Clay, Oakdale, MN (US)

(73) Assignee: Valterra Products, Inc., Mission Hills, CA (US)

( * ) Notice: Subject to any disclaimer, the term of this patent is extended or adjusted under 35 U.S.C. 154(b) by 0 days.

(21) Appl. No.: 10/693,597

(22) Filed: Oct. 27, 2003

(65) Prior Publication Data

US 2005/0087483 A1 Apr. 28, 2005

(51) Int. Cl.
*B01D 35/00* (2006.01)
*B01D 29/17* (2006.01)

(52) U.S. Cl. ..... 210/238; 210/448; 210/470

(58) Field of Classification Search ..... 210/169, 210/167.01, 167.1, 170.09, 232, 238, 448, 210/470; 15/1.7
See application file for complete search history.

(56) References Cited

U.S. PATENT DOCUMENTS 4,448,686 A * 5/1984 Friedman ..... 210/238
5,336,403 A * 8/1994 Marbach ..... 210/169
D381,781 S * 7/1997 Clay ..... D32/35
6,592,756 B1 * 7/2003 Felix et al. ..... 210/169
2004/0089593 A1 * 5/2004 Campbell ..... 210/169

* cited by examiner

*Primary Examiner*—Fred G. Prince
(74) *Attorney, Agent, or Firm*—Larry F. Gitlin, Esq.

(57) ABSTRACT

An improved device for collecting and removing debris from a swimming pool, pond or the like comprising a mesh material formed into a net for collecting and temporarily storing the debris. The net includes a top open portion with a support frame and a bottom closed portion forming a vertex. A pole or extensible rod is attached to the end of the frame for holding and manipulating the device through the water. Also provided is a means connected to the bottom closed portion of the net enclosed within the netting to maintain the vertex portion of the net in an open and receptive position while it is manipulated and moved along and below the water's surface to collect and remove debris. The means, when rotated to a horizontal position, expands the bottom closed portion of the net to facilitate the collection of debris and is also used as a device for grasping the bottom closed portion of the net in the process of emptying the net of debris.

9 Claims, 4 Drawing Sheets

POOL LEAF REMOVAL NET

BACKGROUND OF THE INVENTION

1. Field of the Invention

The present invention relates to swimming pools and the like and, more particularly, to an improved device for collecting and removing leaves and assorted debris laying on and beneath the water's surface.

2. Description of the Prior Art

Mechanical or hand held devices for skimming and reaching below the water's surface in a swimming pool, man made pond or the like are well known in the prior art. The most common of these devices is a leaf skimmer or skim net usually comprised of a mesh netting material supported by a rigid frame attached to an elongated and/or telescopic pole to enable the net to reach deep below the surface.

A search of the prior art did not disclose any patents that read directly on the claims of the instant invention. However, the following references are considered related:

| U.S. Pat. No. | Inventor | Issue Date |
|---|---|---|
| 4,053,412 | Stix | Oct. 11, 1977 |
| 4,846,972 | Anderson | Jul. 11, 1989 |
| 5,579,610 | Jackson | Dec. 3, 1996 |
| Des. 381,781 | Clay | Jul. 29, 1997 |
| 6,398,952 | Baer | Jun. 4, 2002 |

Nevertheless, none of the devices disclosed by the references teaches a means attached to a skim net and enclosed within the net's vertex section that enhances the debris collection and removal capability of the present invention.

Most of the devices disclosed in the prior art do not include the means to accomplish the objectives of the present invention, including causing the net to remain open and fully expanded, particularly at the vertex end, as the net is pulled through the water and providing the means to more easily grasp the end of the net to facilitate the removal of collected debris.

The structure disclosed in U.S. Pat. No. Des. 381,781, though similar in some respects to the present invention, is different in the most essential areas. For example, the ring device in the patent is attached to and hangs below and outside of the vertex of the net where it can easily snag foreign objects, which can seriously interfere with the debris collection process. In its position hanging from the bottom of the net, the ring with its weight and resistance tends to pull the vertex and contract or narrow the area within. This allows significantly less space to collect and store debris and inhibits the process generally.

Thus, there is a need for the present invention to address and resolve the differences of the prior art.

SUMMARY OF THE INVENTION

In its preferred embodiment, the present invention provides an improved device for collecting and removing debris from a swimming pool, pond or the like comprising a mesh material formed into a net for collecting and temporarily storing the debris. The net has a top open portion with a support frame and a bottom closed portion forming a vertex. A pole or extensible rod is attached to the end of the frame for holding and manipulating the device through the water. Also provided is a device connected to the bottom closed portion of the net enclosed within the netting to maintain the vertex portion of the net in an open and receptive position while it is manipulated and moved along and below the water's surface to collect and remove debris. This device expands the bottom closed portion of the net to facilitate the collection of debris. The device is also used as a means for grasping the bottom closed portion of the net to facilitate the process of emptying the net of debris.

Accordingly, it is an object of the present invention to provide an improved device for collecting, storing and removing debris from a swimming pool, pond or the like that employs the means to maintain a skim net at its vertex end in an open and receptive position while it is moved and manipulated along and below the water's surface in the process of collecting, storing and removing debris.

It is also an object of the present invention to provide an improved device for collecting, storing and removing debris from a swimming pool, pond or the like that encloses the means to maintain a skim net at its vertex end in an open and receptive position with the means attached to the netting material at the vertex end.

It is yet another object of the present invention to provide an improved device for collecting, storing and removing debris from a swimming pool, pond or the like that is attached to the net along the sidewall adjacent the bottom closed portion to enable the means to pivot to a horizontal position over the vertex to expand the area and facilitate the collection and storing of debris.

It is yet another object of the present invention to provide an improved device for collecting, storing and removing debris from a swimming pool, pond or the like that is round, oval or some other suitable geometric shape.

It is yet another object of the present invention to provide an improved device for collecting, storing and removing debris from a swimming pool, pond or the like that acts as a weighting component to assist the skim net to more easily reach under the water's surface and drag itself along the bottom of the pool to collect and store debris.

It is yet another object of the present invention to provide an improved device for collecting, storing and removing debris from a swimming pool, pond or the like that is easy to use and cost effective to manufacture.

Other objects and advantages of the present invention will become apparent in the following specifications when considered in light of the attached drawings wherein a preferred embodiment of the invention is illustrated.

BRIEF DESCRIPTION OF THE DRAWINGS

FIG. 1 is a perspective view of a prior art device used to collect and remove debris from a swimming pool, pond or the like.

DETAILED DESCRIPTION OF THE PREFERRED EMBODIMENT

Figure 1:
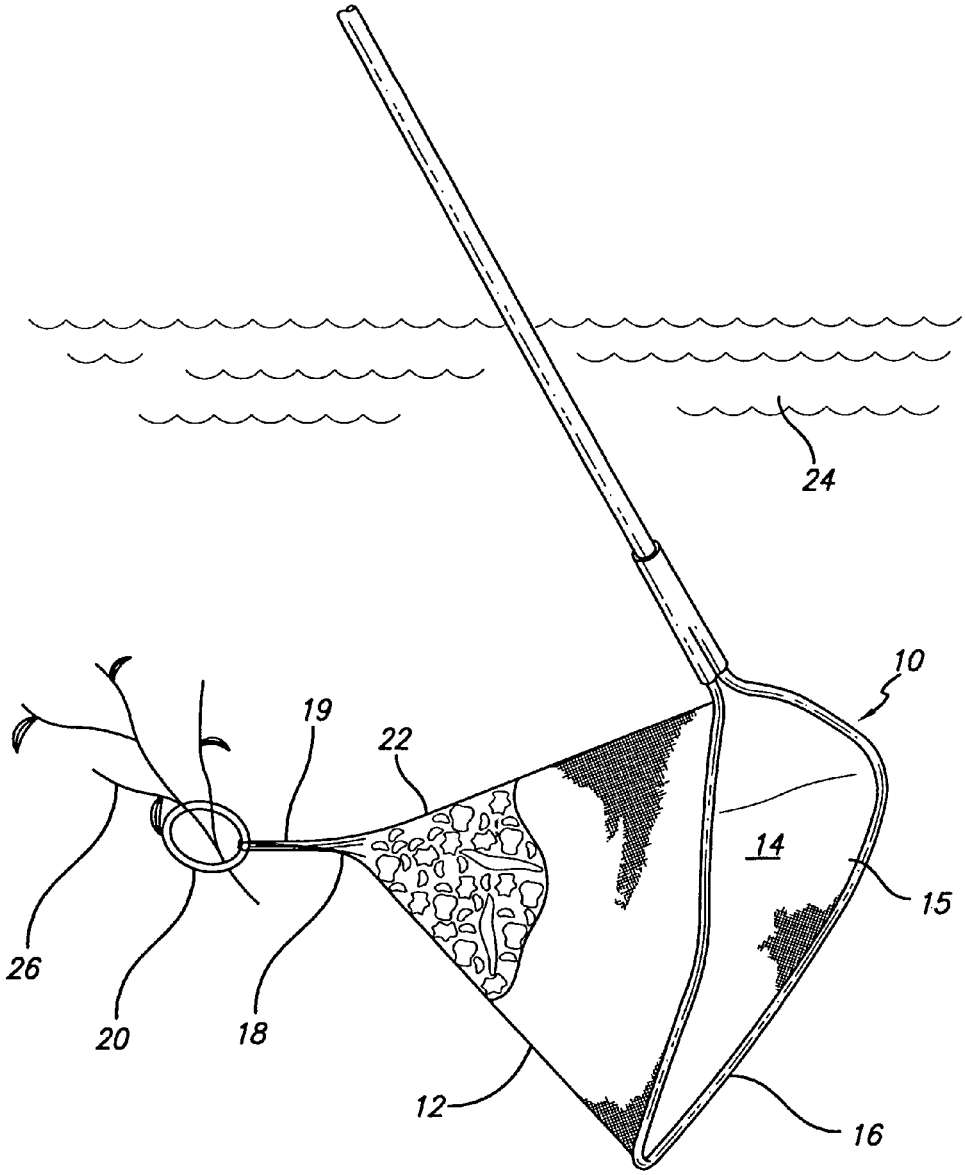
FIG. 1 PRIOR ART

Referring more particularly to the drawings, FIG. 1 is a perspective view of a typical prior art device 10 for collecting and removing debris from a swimming pool, pond or the like. Shown in FIG. 1 is a conventional generally conical shape net 12 with a relatively large opening 14 at one end 15 supported by a frame 16 and a closed vertex portion 18 formed at the opposite end 19. In this embodiment of the prior art, attached to the net 12 outside the vertex portion 18 is a ring 20. Collected debris 22 is shown inside net 12. Ring 20 offers additional physical resistance as net 12 is dragged through the water 24, and pulls at vertex portion 18 causing it to narrow significantly in size. This, in turn, substantially reduces the capacity at end 19 to collect and store debris. Large types of debris, such as fallen tree branches 26 with or without leaves, tend to catch on or snag ring 20 creating an even greater drag coefficient on device 10. Thus, it becomes more difficult for net 12 to maneuver through the water 24 and perform at optimum efficiency.

Figure 2:
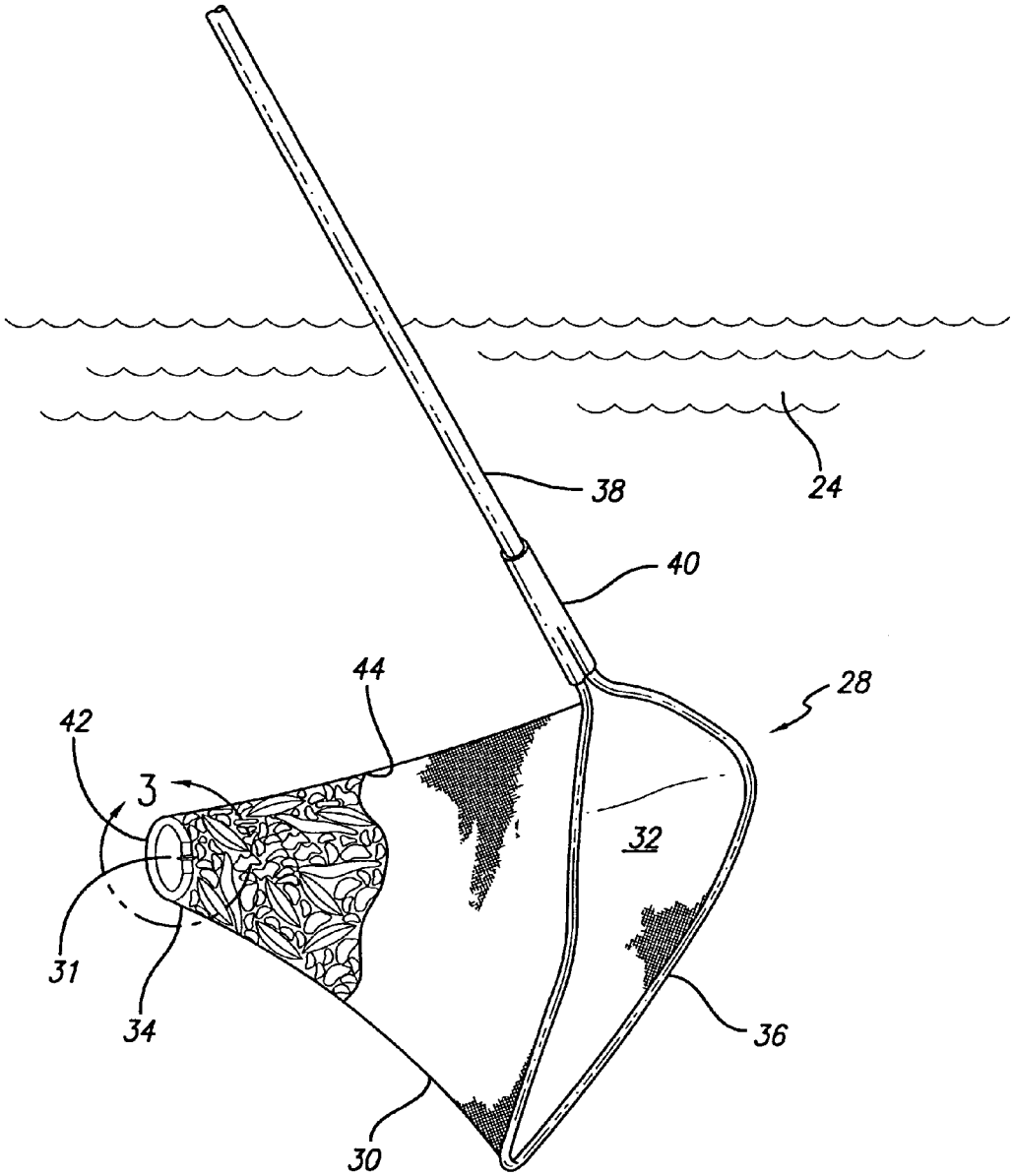
FIG. 2 is a perspective view of the device of the present invention.
Figure 3A:
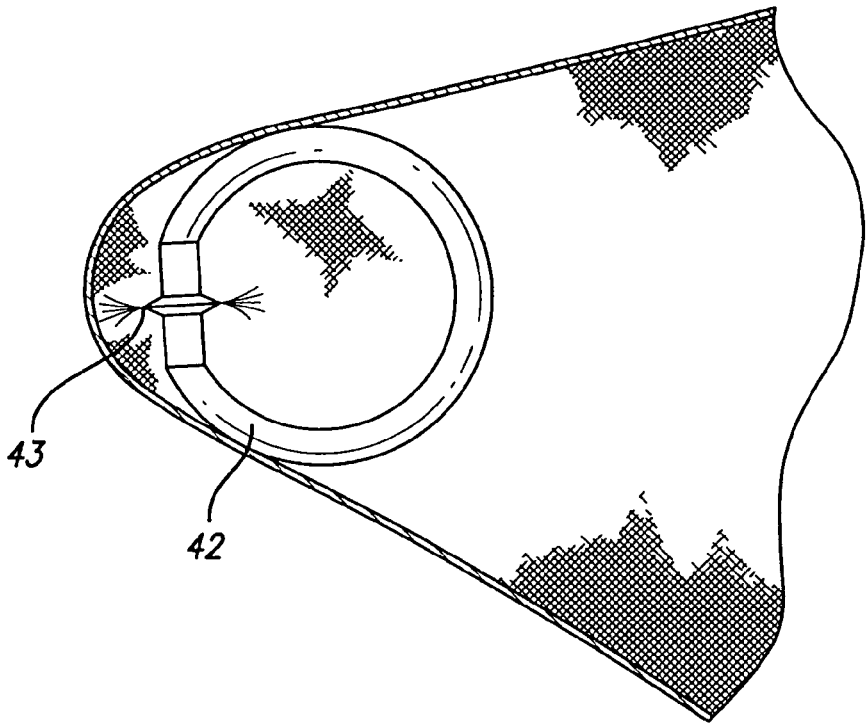
FIG. 3*a* is an enlarged sectional view of the device of the present invention shown encircled by line 3 illustrating the initial or retracted position of the ring component.
Figure 3B:
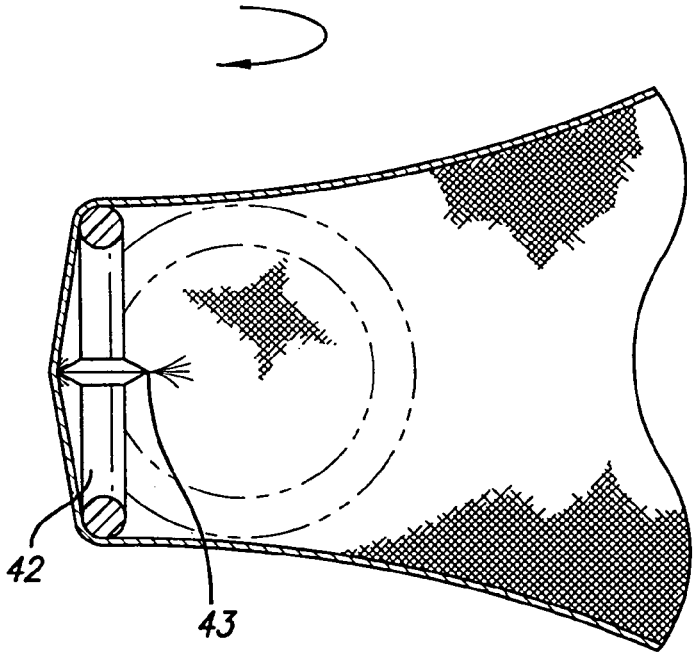
FIG. 3*b* is an enlarged sectional view of the device of the present invention shown encircled by line 3 illustrating the rotated positioning of the ring component.
Figure 4:
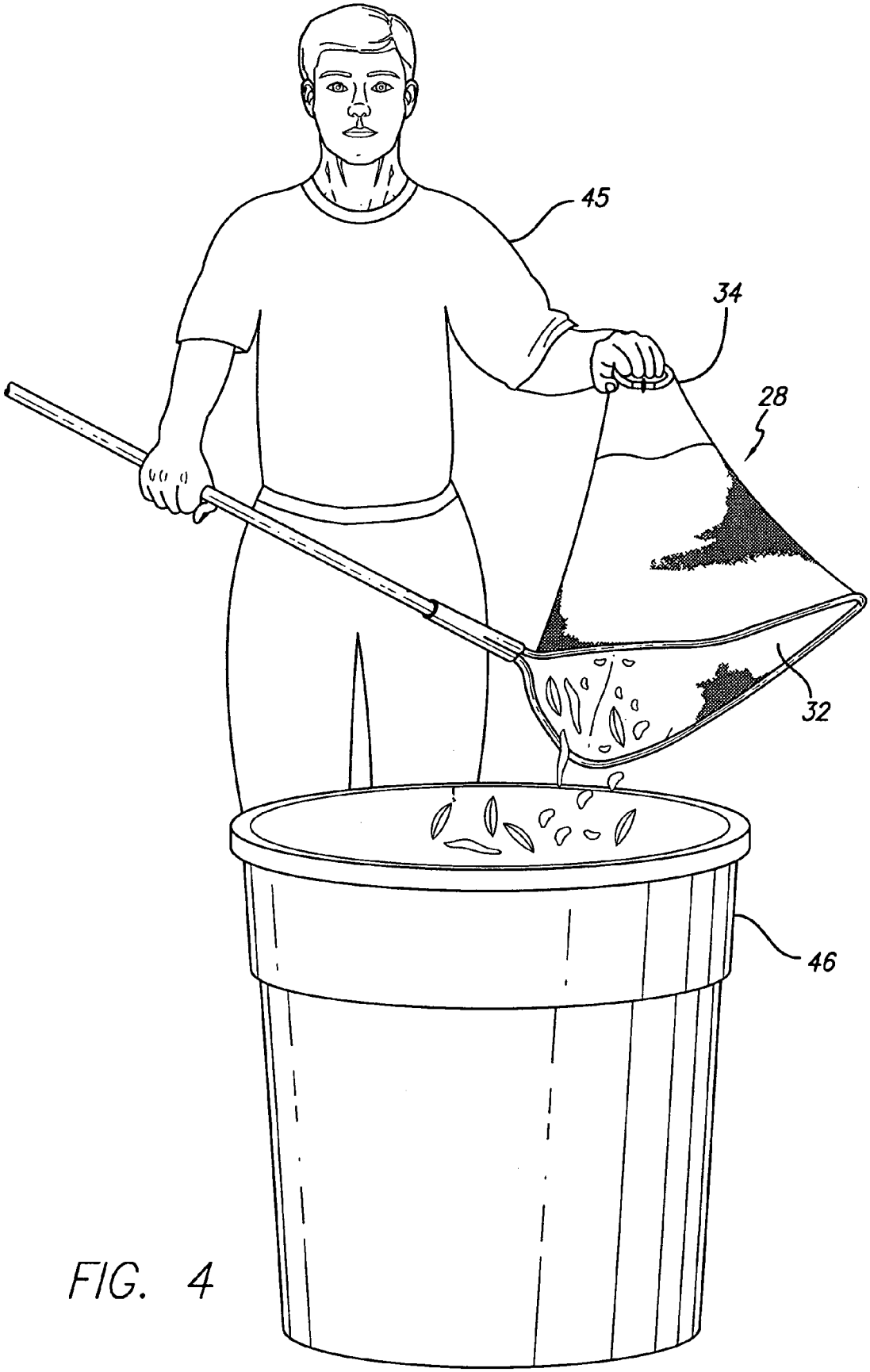
FIG. 4 illustrates how a person employs the device of the present invention to facilitate the emptying of the debris.

FIG. 2 is a perspective view of the preferred embodiment of the present invention depicting a device 28 for collecting and removing debris from a swimming pool, pond or the like comprising a net 30 having relatively large open end 32 and a closed end 34, which forms a vertex 31. Net 30 is comprised of a resilient mesh material made of natural or synthetic fibers. For the types of debris usually found in a swimming pool or a man made pond, smaller size mesh is usually the most effective material to achieve the intended objective.

Open end 32 is supported by a rigid frame 36 made of plastic or a light metal material to hold end 32 opened at all times. Pole 38 is attached to frame 36 at throat portion 40 where the two components are joined and secured. Pole 38 can be a single unit or telescopic in nature to permit device 28 to elongate and reach greater distances and depths.

Ring 42 is attached to net 30 by any suitable means near vertex 31 along the sidewall 44 at point 43. As net 30 is maneuvered through water 24, ring 42 rotates to a generally horizontal position across closed end 34 forcing end 34 to expand to accommodate ring 42. The expansion of vertex 31 and end 34 in this manner facilitates the collection of more debris than is otherwise possible. Moreover, ring 42 is shielded or protected inside net 30, which minimizes the risk that tree limbs, branches or the like will snag ring 42 and inhibit the debris collection process.

Ring 42 is also useful as a means to more securely grip end 34 when emptying net 30 of debris. In this regard, ring 42 is caused to rotate or flip back to its original generally vertical position along inside wall 44 where it can be more easily gripped by an individual 45 when emptying the contents of net 30 into a trash can 46.

Ring 42 is typically round in shape, though other geometric shapes, including oval, rectangular and triangular shapes, may be employed. The dimension(s) of ring 42 may vary depending on the size and shape of net 30. Typically, the components that comprise device 28 are made of synthetic or natural materials with weight, strength and cost being the most significant factors that are considered in selecting the materials to employ.

The choice of mesh size is also important and depends on a variety of factors, including the kind and size of debris to be collected and the need to prevent sticks and generally sharper narrow objects from penetrating and snagging ring 42.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended.

The invention claimed is:

1. A device for collecting, storing and removing debris from a swimming pool or pond comprising:

a net for collecting said debris, said net having a top open portion, a bottom closed portion with a centerline and a continuous sidewall;

a frame for supporting the net around the perimeter of said net;

a pole attached to said frame for holding or manipulating said device; and, a means connected to said bottom closed portion inside of said net to enlarge and expand said closed portion to maintain said net in an open and receptive position while it is manipulated and moved along and below the water's surface to facilitate the collection and storage of debris, and to be used as a means to grasp said bottom closed portion in the process of emptying said net of debris.

2. The device of claim 1 wherein said means connected to said bottom closed portion is ring shaped.

3. The device of claim 1 wherein said means connected to said bottom closed portion is triangular in shape.

4. The device of claim 1 wherein said means connected to said bottom closed portion is square or rectangular in shape.

5. The device of claim 1 wherein said means connected to said bottom closed portion is oval in shape.

6. The device of claim 1 wherein said means connected to said bottom closed portion acts as a weight to assist said device in more easily reaching under the water's surface and dragging itself along the bottom of the pool to collect and store debris.

7. The device of claim 1 wherein said means connected to said bottom closed portion is protected from snagging or catching itself on foreign objects.

8. The device of claim 1 wherein said means connected to said bottom closed portion is attached to said sidewall adjacent said bottom closed portion.

9. A device for collecting, storing and removing debris from a swimming pool, pond or similar body of water comprising:

a net for collecting said debris, said net having a top open portion, a bottom closed portion with a centerline and a continuous sidewall;

a frame for supporting the net around the perimeter of said net;

a pole attached to said frame for holding or manipulating said device; and, a means connected to said bottom closed portion inside of said net to maintain said net in an open and receptive position while it is manipulated and moved along and below the water's surface to collect, store and remove debris, and to be used as a means to grasp said bottom closed portion in the process of emptying said net of debris, said means being attached to said net in a laterally offset manner relative to the centerline of said bottom portion to enable said means to rotate and lay generally horizontal against said bottom portion.

* * * * *